US009894433B2

(12) United States Patent
Bridge

(10) Patent No.: US 9,894,433 B2
(45) Date of Patent: Feb. 13, 2018

(54) AUDIO WAVE GUIDE

(71) Applicant: PK Event Services Inc., Calgary (CA)

(72) Inventor: Jeremy Bridge, Calgary (CA)

(73) Assignee: PK Event Services Inc. (CA)

( * ) Notice: Subject to any disclaimer, the term of this patent is extended or adjusted under 35 U.S.C. 154(b) by 12 days.

(21) Appl. No.: 14/724,454

(22) Filed: May 28, 2015

(65) Prior Publication Data

US 2015/0365758 A1 Dec. 17, 2015

Related U.S. Application Data

(60) Provisional application No. 62/012,530, filed on Jun. 16, 2014.

(51) Int. Cl.

| | |
|---|---|
| ***H04R 1/02*** | (2006.01) |
| ***H04R 1/34*** | (2006.01) |
| *H04R 1/24* | (2006.01) |
| *H04R 27/00* | (2006.01) |

(52) U.S. Cl.
CPC ..... *H04R 1/345* (2013.01); *H04R 1/24* (2013.01); *H04R 27/00* (2013.01)

(58) Field of Classification Search
CPC ..... H04R 1/345; H04R 1/24; H04R 27/00
USPC ..... 381/337
See application file for complete search history.

(56) References Cited

U.S. PATENT DOCUMENTS

| | | | | |
|---|---|---|---|---|
| 1,884,724 | A | 10/1932 | Keller | |
| 4,031,318 | A | 6/1977 | Pitre | |
| 4,314,620 | A | 2/1982 | Gollehon | |
| 5,754,669 | A * | 5/1998 | Shiota | H04R 1/023 381/189 |
| 6,343,133 | B1 * | 1/2002 | Adamson | H04R 1/26 181/152 |
| 7,035,425 | B2 | 4/2006 | Hutt et al. | |
| 7,324,654 | B2 | 1/2008 | Opie et al. | |
| 7,333,626 | B2 | 2/2008 | Opie et al. | |
| 7,577,265 | B2 | 8/2009 | Pazandeh | |
| 8,515,102 | B1 | 8/2013 | Waller | |
| 8,607,922 | B1 | 12/2013 | Werner | |
| 8,712,091 | B2 | 4/2014 | Taylor et al. | |
| 2002/0014369 | A1 | 2/2002 | Engebretson | |
| 2002/0106097 | A1 * | 8/2002 | Danley | H04R 1/26 381/345 |
| 2003/0188920 | A1 * | 10/2003 | Brawley, Jr. | H04R 1/345 181/176 |
| 2007/0263878 | A1 | 11/2007 | Yu et al. | |

(Continued)

*Primary Examiner* — Sean H Nguyen

(74) *Attorney, Agent, or Firm* — St. Onge Steward Johnston & Reens, LLC

(57) ABSTRACT

A speaker driver assembly for use in a speaker system is provided. The speaker driver assembly includes at least one centrally located high frequency sound driver and at least one mid-range frequency sound driver located to either side of the high frequency sound driver. A waveguide wall in the front of the speaker driver assembly directs the high frequency sound waves outwards from a centrally located opening. The waveguide wall has a plurality of small apertures in front of each mid-range frequency driver that are angled outwardly to allow mid-range sound waves to pass through the apertures while minimizing diffraction of high frequency sound waves passing by the apertures in order to generate a coherent sound wave front.

33 Claims, 15 Drawing Sheets

(56) References Cited

U.S. PATENT DOCUMENTS

| | | | | |
|---|---|---|---|---|
| 2008/0144873 | A1* | 6/2008 | Grant ..... | H04R 1/025<br>381/350 |
| 2011/0268292 | A1 | 11/2011 | Suvanto et al. | |
| 2011/0274306 | A1 | 11/2011 | Adams | |
| 2013/0336516 | A1 | 12/2013 | Stewart et al. | |

* cited by examiner

AUDIO WAVE GUIDE

FIELD OF THE INVENTION

The invention relates to an audio system, and particularly to an audio wave guide for use in an audio system.

BACKGROUND OF THE INVENTION

Professional audio systems generally use multiple multi-way loudspeaker boxes in order to achieve and direct high levels of sound pressure in large spaces such as arenas and stadiums. Line array loudspeaker systems are typically used wherein each loudspeaker box or enclosure in the line array has multiple sound drivers for reproducing the desired wide range of sound frequencies at a high output level. Having multiple sound drivers creates problems with wave interferences at different frequencies and different locations throughout the intended listening area. Typically the intended listening area covers angular dimensions of 60 degrees vertically by 120 degrees horizontally. The interferences reduce the fidelity and clarity of the sound, particularly at larger angles from the array.

Loudspeaker systems often have one or more high frequency drivers or tweeters in the center for reproducing high frequency sound waves approximately in the range of 600 to 20,000 Hz. Sound radiating from the high frequency driver will generally radiate in all directions unless directed by waveguides or sidewalls. Thus, sidewalls and/or waveguides are generally placed adjacent each side of the high frequency driver to form an angle to direct the high frequency sound waves, with the high frequency driver located at the or near the vertex of the angle. Typically each sidewall or waveguide is angled at approximately 30-60 degrees off a center line in order to cover a 60-120 degree horizontal listening area.

Many prior art loudspeaker systems place one or more midrange frequency sound drivers adjacent the central high frequency driver(s) for emitting midrange frequency sound waves in the range of 200 Hz to 2000 Hz. The midrange drivers are often part of the sidewalls or waveguides that direct the high frequency sound waves. This can cause inconsistencies in the wave front since the midrange drivers typically have irregular surfaces that interrupt the path of the passing high frequency sound waves, introducing diffraction edges and cavities that cause reflections, creating cancellations and summations of sound waves which causes inconsistencies in the frequency response.

There have been numerous attempts to solve the aforementioned problems and to design a loudspeaker that can integrate midrange and high frequency sound sources at a high output level to produce a consistent wave front, particularly at larger angles from the loudspeaker. However each solutions has had its drawbacks. While an ideal flat frequency response may be able to be produced in certain locations in a polar response area, there is often a less than ideal frequency response in other locations in the polar response area.

U.S. Patent Publication No. 2002/0014369 to Engebretson and U.S. Pat. No. 7,333,626 to Opie et al. disclose a system for integrating mid-range and high frequency sound drivers in multi-way loudspeaker system wherein a radiation boundary integrator having foam-filled slots are placed over the mid-range drivers, on either side of the high frequency driver. The foam is substantially transparent to allow mid-range sound waves to pass through the slots while preventing high frequency sound waves from passing through the slots.

U.S. Pat. No. 8,515,102 to Waller discloses a line array speaker system designed to provide a more uniform frequency response to listeners at large off-axis angles to the speakers by using different sized mid-frequency drivers. A pair of smaller mid-frequency drivers straddle a central high frequency driver and are fed a high frequency band within the midrange frequencies, and a pair of larger mid-frequency drivers straddling the smaller mid-frequency drivers and are fed with a lower frequency band in the midrange frequencies.

U.S. Pat. No. 4,031,318 to Pitre discloses an older version of a loudspeaker system wherein the mid-range speaker drivers are in a separate enclosure from the high and low frequency drivers.

U.S. Pat. No. 7,557,265 to Pazandeh teaches a speaker system having various low, mid-range and high frequency drivers. The high frequency driver is in the center and projects sound vertically upward, and the mid-range drivers project sound at an angle toward each other and toward the high frequency driver so as to intersect and cause an echo effect to improve sound spaciousness.

U.S. Patent Publication No. 2007/0263878 to Yu et al. teaches a sound mask for use on a multi-channel sound box containing more than one speaker driver. The sound mask has angled and straight circular apertures for directing the sound waves from the speaker drivers in a wider sound field. Yu et al. is not directed to professional loudspeaker systems designed to produce high sound pressure levels.

Various other prior art references, such as U.S. Patent Publication No. 2013/0336516; U.S. Pat. No. 7,035,425 and U.S. Pat. No. 8,712,091 teach speaker system designs. However these systems are not directed to professional audio systems for high sound pressure levels that include both midrange and high frequency drivers in one enclosure. U.S. Pat. No. 1,884,724 to Keller discloses a sound box for phonic diaphragms having adjustable apertures in the front of the sound box to control the operating characteristics of the sound box. U.S. Patent Publication No. 2011/0268292 to Suvanto et al. teaches an apparatus for use in devices, such as mobile devices, that have acoustic transducers.

There continues to be a need for a professional loudspeaker system that causes a coherent wave front from a loudspeaker enclosure having both high frequency and mid-range frequency sound drivers for use in large venues wherein a wide frequency response area is needed.

SUMMARY OF THE INVENTION

In accordance with the invention, there is provided a speaker driver assembly and a waveguide for use in a speaker driver assembly.

In accordance with one aspect of the invention, there is a provided a waveguide for use in a speaker driver assembly having at least one high frequency driver for emitting sound waves out at least one high frequency opening, and at least one mid-range frequency driver located adjacent the high frequency driver, the waveguide for placement in front of the mid-range frequency driver, the waveguide comprising at least one wall having an outer surface, an inner surface and a proximal edge, the inner surface for facing the mid-range frequency driver, and the proximal edge for placement adjacent the high frequency opening; and a plurality of apertures in the at least one wall for allowing sound waves from the mid-range frequency driver to pass through, the apertures angled outwardly away from the proximal edge from the inner surface to the outer surface.

In another aspect of the invention, there is provided a speaker driver assembly comprising an enclosure having a front side; at least one high frequency driver in the enclosure for emitting high frequency sound waves on an exit path out a high frequency opening on the front side of the enclosure; at least one mid-range frequency driver in the enclosure adjacent the high frequency opening for emitting mid-range frequency sound waves; and at least one waveguide wall including an outer surface; an inner surface facing the at least one mid-range frequency driver; a proximal edge adjacent the high frequency opening; and a plurality of apertures for allowing the mid-range frequency sound waves to pass through, the plurality of apertures angled outwardly away from the proximal edge from the inner surface to the outer surface for allowing the high frequency sound waves to pass by the outer surface with minimal diffraction from the exit path.

In a further embodiment, there is a provided a speaker cabinet for use in a speaker system comprising the above speaker driver assembly.

In one embodiment, the plurality of apertures of the waveguide are angled outwardly at an angle of 25 to 75 degrees with respect to the at least one waveguide wall.

In another embodiment, the waveguide comprises at least two walls that form an angle to each other for placement in the speaker driver assembly with the at least one high frequency driver at the vertex of the angle.

In a further embodiment, the plurality of apertures of the waveguide are less than 17 mm in diameter. The plurality of apertures may comprise apertures of more than one size. In one embodiment, the apertures of the plurality of apertures comprise at least three different sizes.

In one embodiment, the spacing between adjacent apertures in the plurality of apertures is not regular. The apertures may be arranged in an irregular or semi-randomized configuration. Alternatively, the plurality of apertures are arranged in a regular pattern. The plurality of apertures may be configured symmetrically and/or in a geometric pattern. In one embodiment, each aperture of the plurality of apertures may have a substantially constant diameter from the inner surface to the outer surface.

In another embodiment of the invention, the speaker driver assembly has a plurality of mid-range frequency drivers and there is a cluster of a plurality of apertures in front of each mid-range frequency driver.

In yet another embodiment, minimal diffraction may mean that the distance travelled of the high frequency sound waves off the exit path and back onto the exit path is less than ¼ of a wavelength of the highest frequency sound waves emitted.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION OF THE INVENTION

Figure 1:
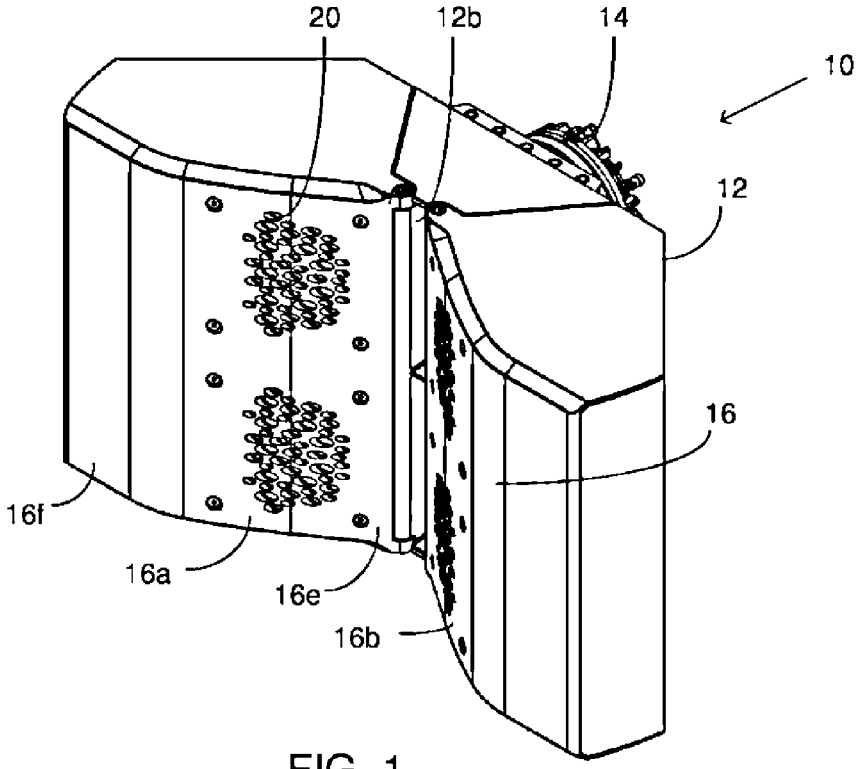
FIG. 1 is a perspective view of a speaker driver assembly in accordance with one embodiment of the invention.

With reference to the figures a speaker driver assembly 10 for use in a speaker system is described.

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

Referring to FIGS. 1 to 5 and 18, the speaker driver assembly 10 comprises a driver enclosure 12 containing one or more high frequency drivers 14 located in the center of the assembly that project high frequency sound waves towards the front of the enclosure that exit the enclosure via one or more openings 12*b*. A waveguide 16 having waveguide walls 16*a*, 16*b* extending at an angle outwards from each side of the openings 12*b* guides the path of the high frequency waveguides from the openings. One or more mid-range frequency drivers 18 are located in the driver enclosure on either side of the high frequency driver, behind the waveguide walls. A plurality of apertures 20 are located in the waveguide walls to allow mid-range frequency sound waves to exit the enclosure through. The shape and configuration of the apertures is designed to prevent the high frequency sound waves from diffracting off their original path as they pass by the apertures, as discussed in more detail below

The Apertures

Figure 2:
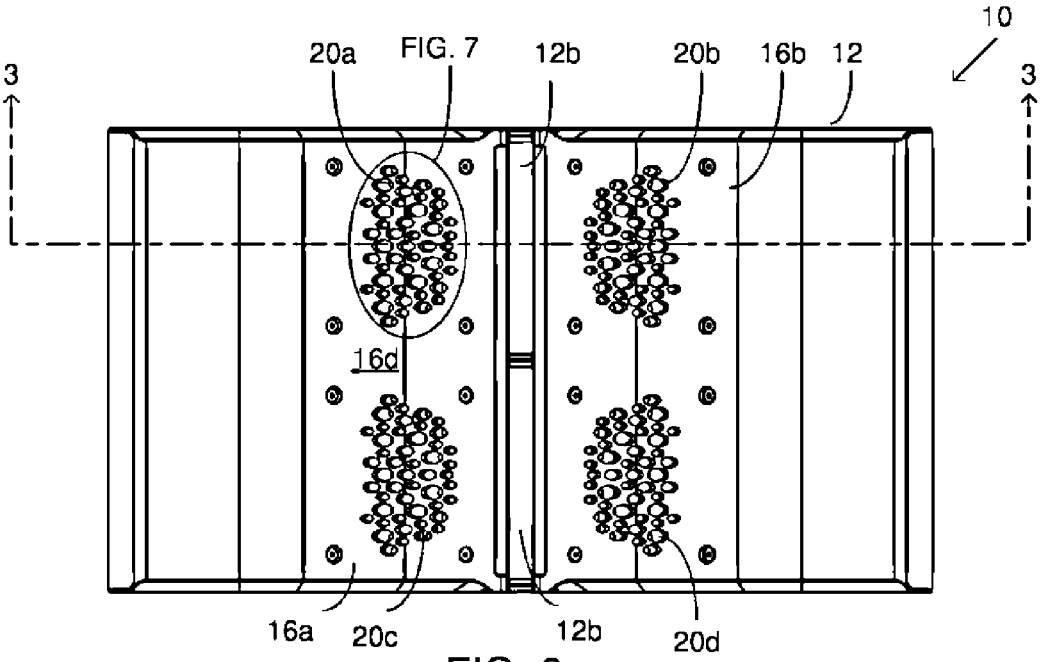
FIG. 2 is a front elevational view of the speaker driver assembly of FIG. 1.
Figure 18:
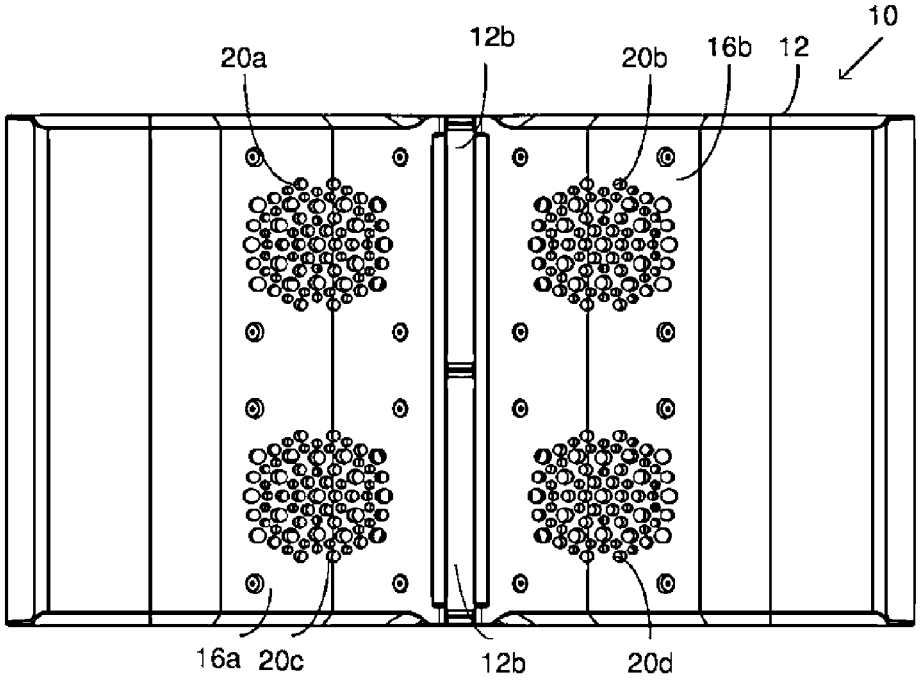
FIG. 18 is a front elevational view of a speaker driver assembly in accordance with one embodiment of the invention, the speaker driver assembly having a different aperture pattern than the speaker driver assembly of FIG. 1.

Referring to FIGS. 2 and 18, the waveguide 16 comprises a plurality of apertures, which may be configured in one or more aperture sets or clusters of apertures 20*a*, 20*b*, 20*c*, 20*d*, wherein one aperture set is located in front of each mid-range frequency driver. The number of aperture sets preferably matches the number of mid-range frequency drivers in the driver assembly.

Figure 6:
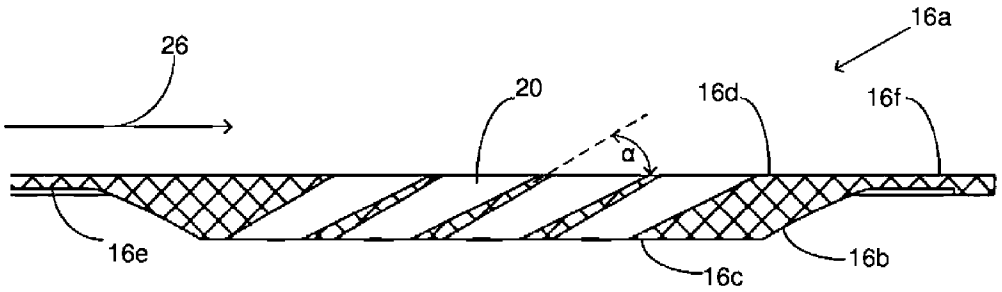
FIG. 6 is a top cross sectional view of a waveguide wall of the speaker driver assembly in accordance with one embodiment of the invention.
Figure 20:
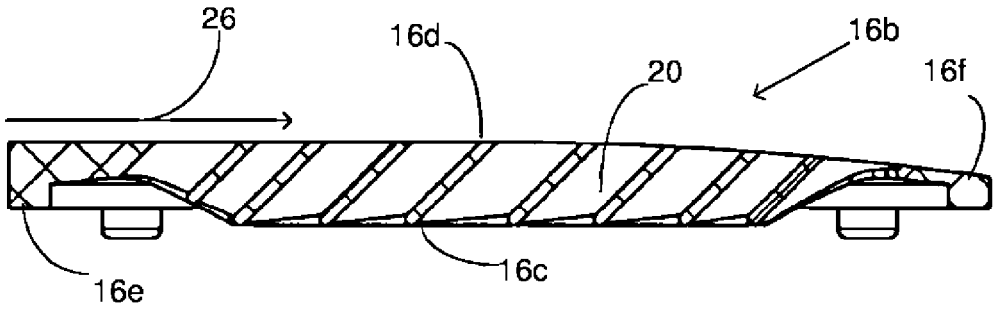
FIG. 20 is a top cross sectional view of the aperture set of the waveguide wall of FIG. 19, taken along line A-A of FIG. 19.
Figure 21:
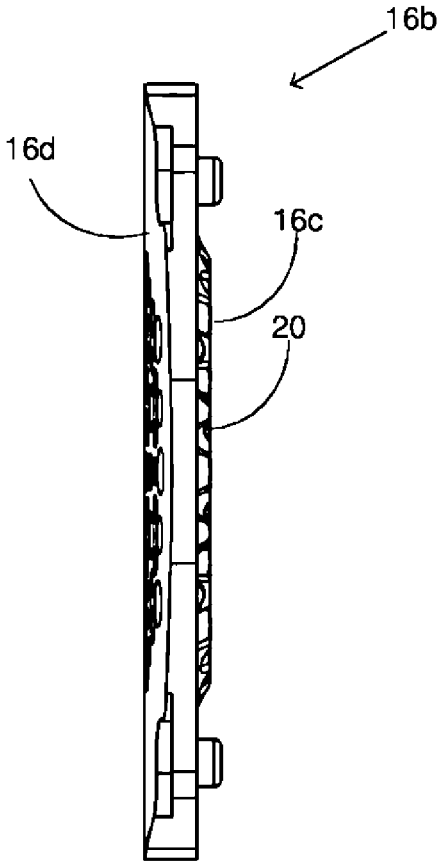
FIG. 21 is a side view of the aperture set of the waveguide wall of FIG. 19.

FIGS. 6 and 20 are top cross-sectional views of one of the waveguide walls 16*b* of the invention showing the angle of the apertures 20. The apertures 20 are angled outwardly from an inner surface 16*c* to an outer surface 16*d* of the waveguide wall, in a direction of travel of the high frequency sound waves 26. That is, the apertures are angled outwardly from a proximal portion 16*e* of the waveguide wall having a proximal edge located adjacent the high frequency driver opening(s) 12*b*, to a distal portion 16*f* of the waveguide wall having a distal edge. The angle $\alpha$ of the apertures is preferably in the range of 25° to 75° from the inner or outer surface of the waveguide wall, more preferably in the range of 30° to 60°, even more preferably in the range of 40° to 50°, and more preferably approximately 45°.

Figure 7:
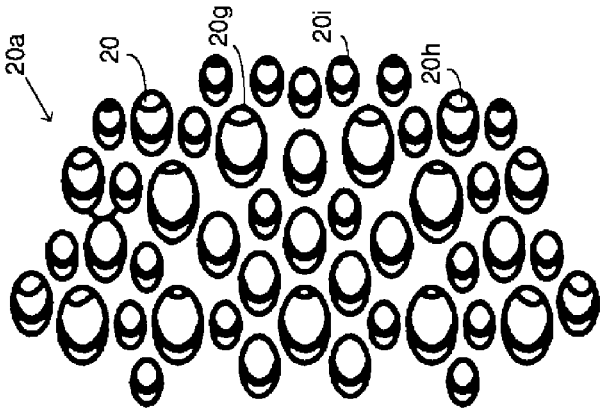
FIG. 7 is an enlarged front elevational view of an aperture set of the speaker driver assembly of FIG. 1.

FIG. 7 is a blown up view of one aperture set 20*a*. The aperture set is illustrated as clustered in a roughly semi-circular pattern, however other shapes for the aperture set could be used. FIGS. 18, 19, 20 and 21 illustrate another embodiment for an aperture set, wherein the apertures are clustered in a symmetrical and roughly circular pattern.

Preferably, the apertures have relatively small diameters, i.e. the diameters are less than the shortest wavelength of the high frequency sound waves, in order to minimize diffraction and reflections causing constructive and destructive interference of soundwaves. For example, high frequency sound drivers generally emit sound waves up to 20 kHz in frequency. Presuming a speed of sound of 343 m/s (i.e. the speed of sound in dry air at room temperature and sea level), a 20 kHz sound wave would have a wavelength of approximately 17 mm, meaning that "relatively small" means the aperture is less than 17 mm in diameter (or for non-circular apertures, less than 17 mm at their widest points). More preferably the aperture is 15 mm or less in diameter, even more preferably the aperture is 13 mm or less in diameter, and even more preferably the apertures are less than 11 mm in diameter.

Figure 19:
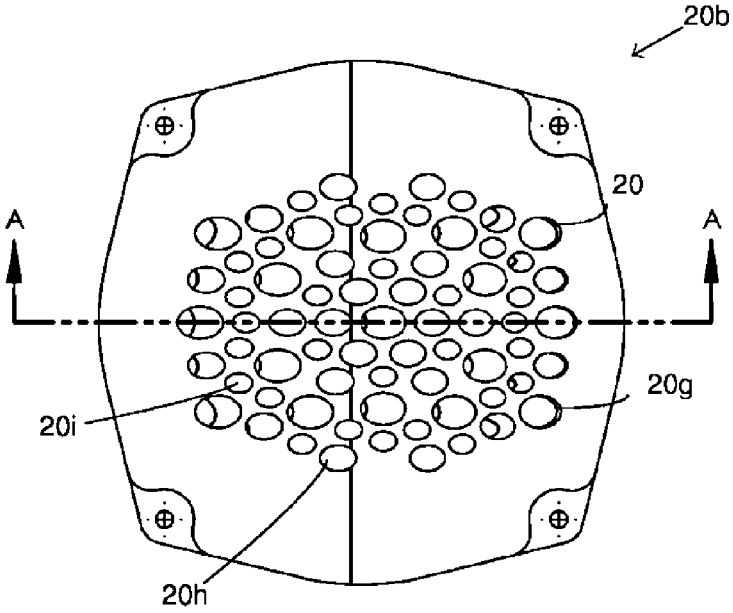
FIG. 19 is an enlarged front elevational view of an aperture set of a waveguide wall of the speaker driver assembly of FIG. 18.

In one embodiment, the apertures are of different sizes, such as the three sizes 20*g*, 20*h*, 20*i* shown in FIGS. 7 and 19. Preferably, the apertures are relatively small and range in size from 4 to 12 mm, and more preferably from 6 to 10 mm.

In one embodiment, the size of each aperture is constant from the inner surface to the outer surface of the waveguide wall, i.e. the apertures are not tapered, as shown in FIGS. 6 and 20. In another embodiment (not shown), the apertures may be tapered between the inner and outer surface of the waveguide wall.

A consistent shape and configuration for the apertures can create cancellations and additions (i.e. constructive or destructive interference) at frequencies where the distance of the aperture opening is equal to ½ or one full wavelength of the sound wave, or even multiples of the wavelength. Accordingly, in one embodiment, the apertures are in a semi-randomized pattern to prevent constructive and destructive interference of sound waves. That is, the apertures are not in a regular, repeating pattern with consistent placement and spacing. Instead, there are various distances between the apertures and/or various angles between adjacent apertures.

In the illustrated embodiment, the apertures are circular in shape, however they appear oval due to the angle they are being viewed from in FIG. 7. The apertures may be other shapes, including but not limited to ovals, hexagons, squares, and asymmetrical shapes.

Path of the Sound Waves

Figure 8:
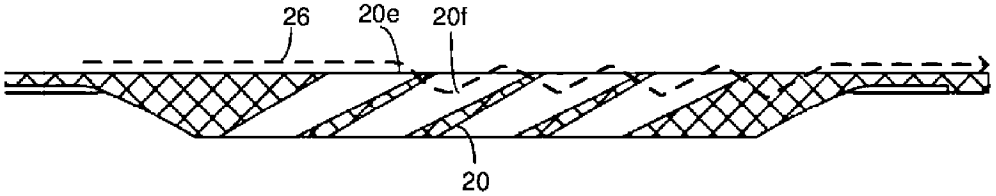
FIG. 8 is a top cross sectional view of the waveguide wall of FIG. 6 illustrating the path of the high frequency sound waves in accordance with one embodiment of the invention.

Referring to FIG. 8, the path of the high frequency sound waves 26 as they travel along the waveguide is illustrated by the broken arrow. When a high frequency sound wave encounters an aperture, it diffracts around a leading edge 20*e* into the aperture until it encounters the trailing wall 20*f* of the aperture, which reflects the sound wave back on its original path to join the wave front travelling along the waveguide. That is, the sound wave is typically prevented from going all the way through the aperture to the mid-range driver, thus preventing a large reflection path back out from the mid-range driver that would be incoherent with the original high frequency wave, causing inconsistencies in the wave front. Instead, only small diffractions and reflections of the sound wave occurs as it passes by each aperture. This allows for the wave front to remain coherent since the apertures are sized and angled such that the difference in distance traveled between the original wave propagation and the redirected wave is less than ¼ wavelength of the highest frequency wavelength being generated (~20 kHz).

Figure 8A:
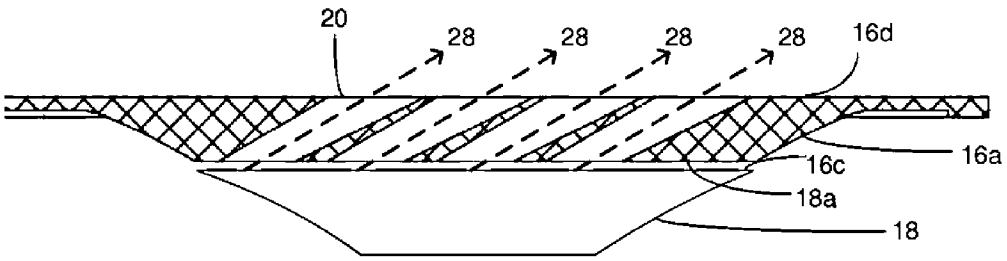
FIG. 8A is a top cross sectional view of the waveguide wall of FIG. 6 illustrating the path of the mid-range frequency sound waves in accordance with one embodiment of the invention.

In FIG. 8A, the broken arrows illustrate the path of the mid-range frequency sound waves 28 emitted from the mid-range frequency driver and passing through the apertures 20 to create a coherent sound wave. The mid-range frequency sound waves have a large enough wavelength that they can pass through the angled apertures uninterrupted, i.e. without diffraction and reflection.

Figure 9:
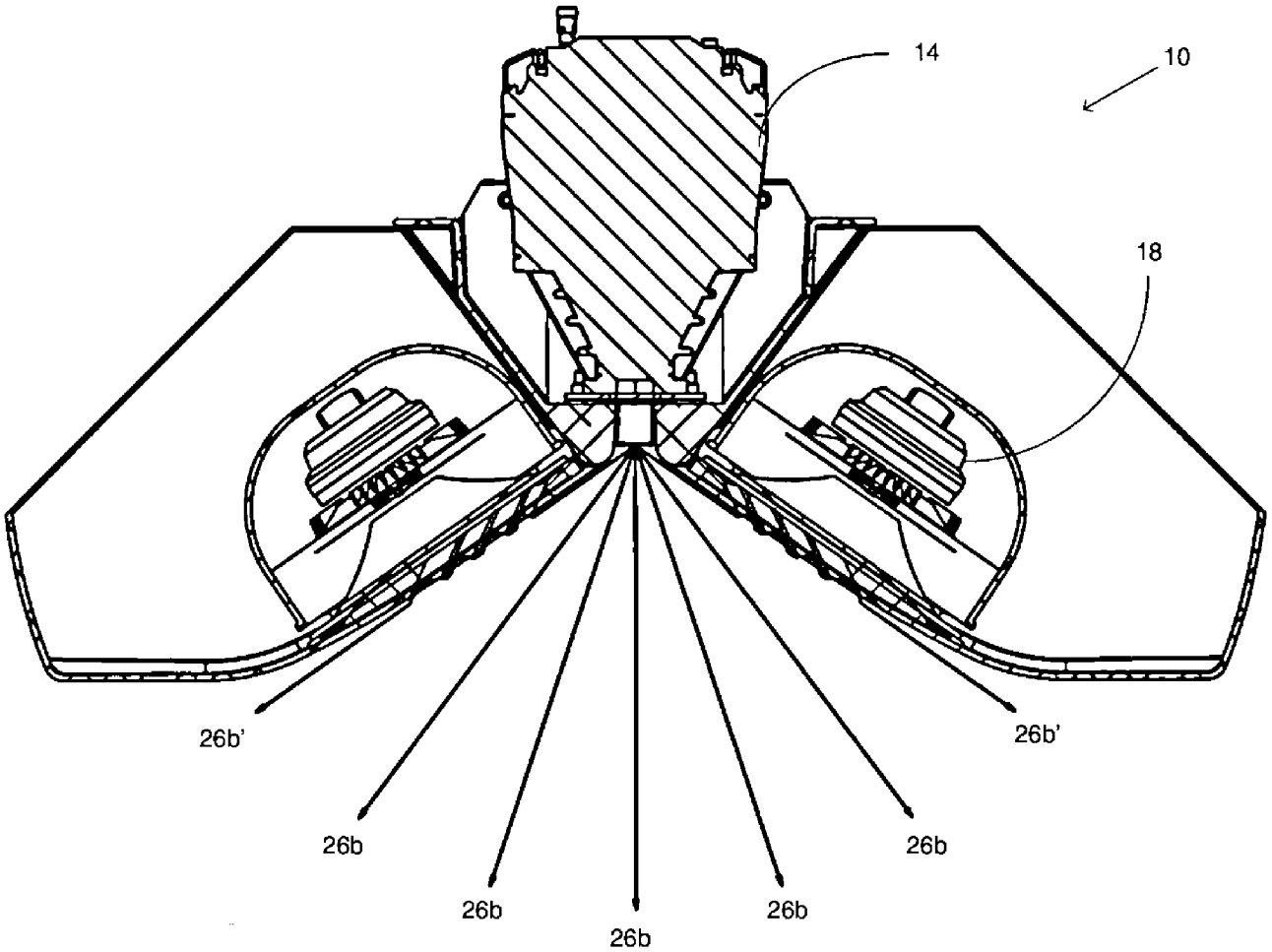
FIG. 9 is a top cross sectional view of the waveguide wall of FIG. 6 illustrating the path of the high frequency sound waves in accordance with one embodiment of the invention.

An illustration on a larger scale of the coherent high frequency wave front created by the assembly is shown in FIG. 9. The high frequency waves exit the openings 12*b* and radiate out from the assembly, shown by the arrows 26*b*, with the horizontal dispersion area being limited by the placement of the waveguide walls 16*a,b*. The sound waves passing directly by the waveguide walls, shown by arrows 26*b*', are not disrupted from their original path due to the size, configuration and shape of the apertures in the waveguide walls, thus creating a coherent wave front.

Figure 10A:
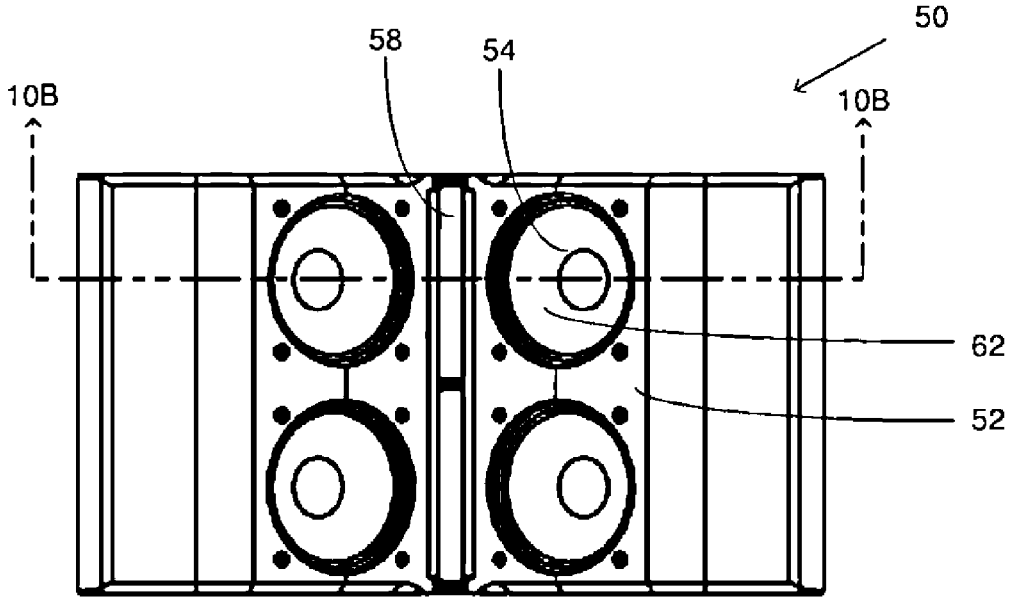
FIG. 10A (PRIOR ART)
FIG. 10A is a front elevational view of a speaker driver assembly of the prior art having a standard waveguide with an opening in front of the mid-range frequency drivers.
Figure 10B:
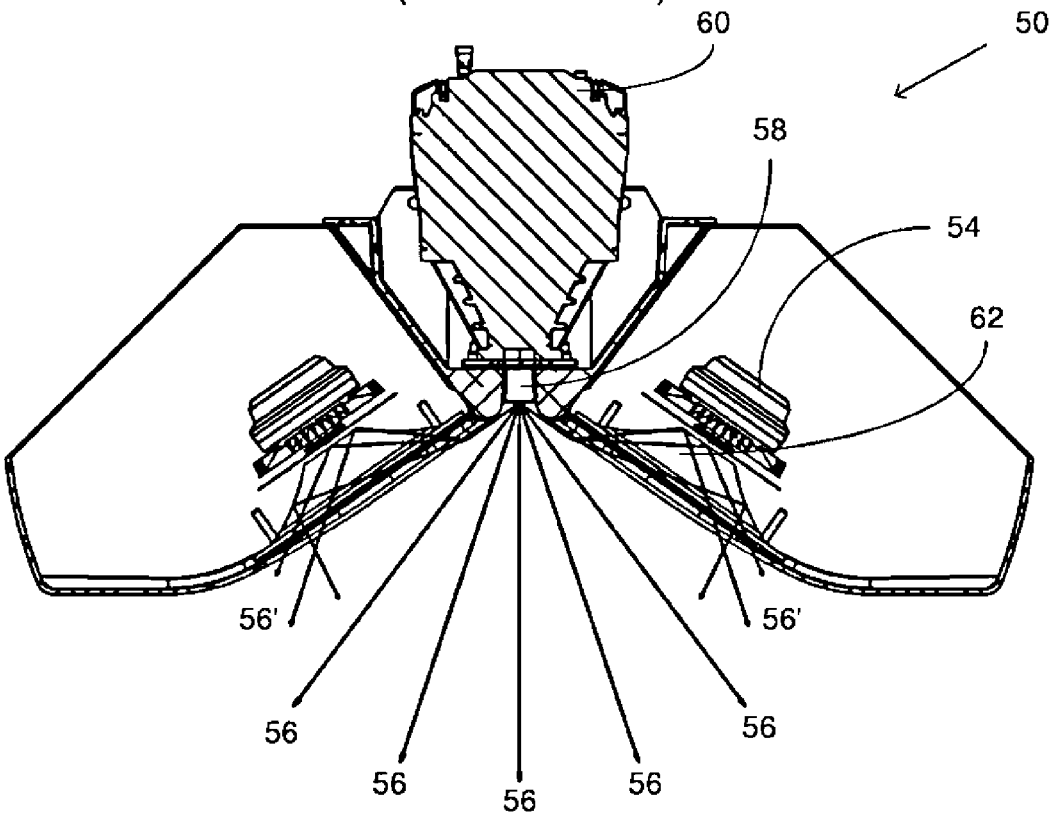
FIG. 10B (PRIOR ART)
FIG. 10B is a top cross sectional view of the speaker driver assembly of FIG. 10A taken along lines 10B-10B illustrating the path of the high frequency sound waves in accordance with the prior art.

In contrast, FIGS. 10A and 10B illustrate the wave front created by a sound drive assembly 50 using a standard waveguide 52 of the prior art that doesn't have any structure in front of the mid-range drivers 54. As can be seen, the high frequency sound waves 56 exiting the opening 58 in front of the high frequency driver(s) 60 do not create a coherent wave front. Instead, the high frequency waves diffract into the cavities 62 in front of the mid-range frequency drivers and reflect off the drivers and surrounding structure at various locations and angles, shown by arrows 56'. Instead of rejoining the original sound wave path, the reflected sound waves are disordered, causing cancellations and summations in sound waves to create an incoherent wave front.

Figure 11A:
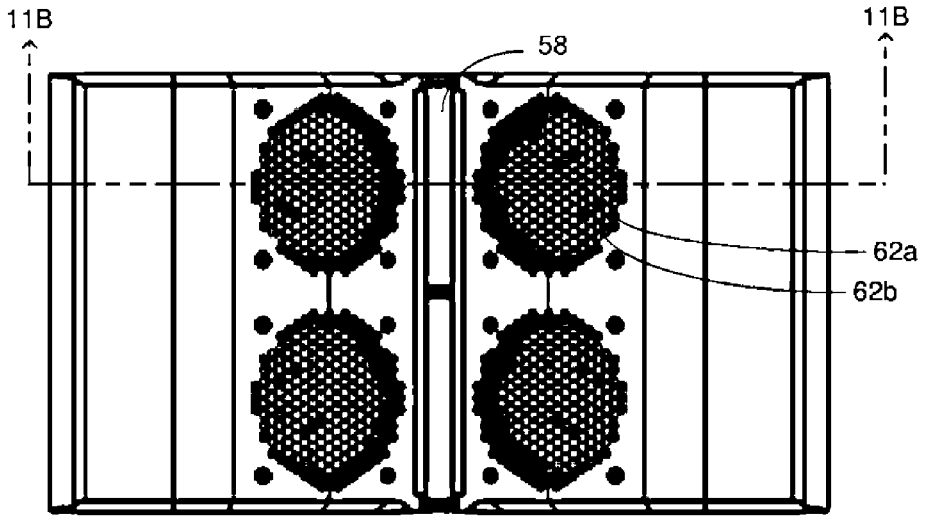
FIG. 11A (PRIOR ART)
FIG. 11A is a front elevational view of a speaker driver assembly of the prior art having a standard waveguide and grill in front of the mid-range frequency drivers.
Figure 11B:
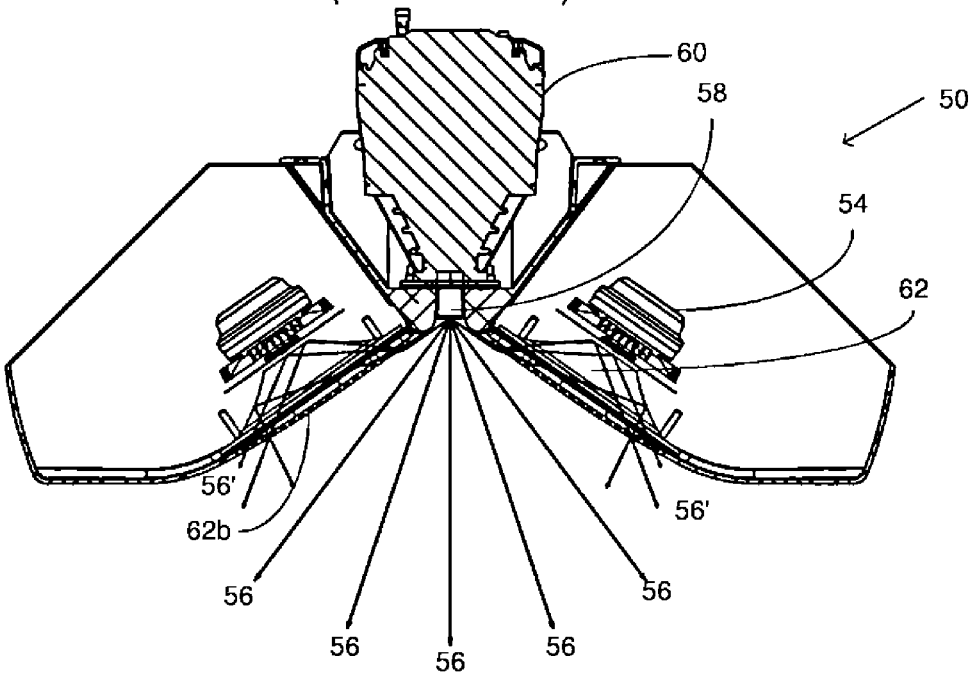
FIG. 11B (PRIOR ART)
FIG. 11B is a top cross sectional view of the speaker driver assembly of FIG. 11A taken along lines 11B-11B illustrating the path of the high frequency sound waves in accordance with the prior art.

FIGS. 11A and 11B illustrate the sound drive assembly 50 of FIGS. 10A and 10B wherein a standard grill 62*b* is placed in front of the cavity 62 in front of each mid-range driver 54. The grill comprises a plurality of apertures 62*a* that extend straight through the waveguide wall. That is, the apertures are not angled but are perpendicular to the waveguide wall, unlike the subject invention. As can be seen in FIG. 11B, the high frequency waves 56 travelling along waveguide diffract into and through the apertures in the grill, reflecting at various angles and locations in the cavity 62 before they find their way out back out of the cavity through the apertures. Similar to when no grill was present in front of the mid-range frequency drivers, the reflected sound waves 56' do not rejoin the original wave path, but are disordered, causing cancellations and summations in sound waves to create an incoherent wave front.

Placement of the Drivers

The mid-range frequency drivers 18 are preferably located as close to the high frequency driver openings 12*b* as possible. In other words, the space between the high frequency driver openings and the mid-range frequency drivers is minimal in order to create a point source for the sound wave front of combined mid-range and high frequency sound waves radiating from the assembly, thus preventing off axis phase cancellations of sound waves.

The mid-range frequency drivers 18 are preferably located as close to the inner surfaces 16*c* of the waveguide walls 16*a,b* as possible, shown in FIG. 8A, and may even abut the inner surface. By minimizing the space between the mid-range frequency drivers and the waveguide walls reflections and reverberations of mid-range frequency sound waves in the space are minimized.

The speaker driver assembly is preferably a symmetrical assembly having one or more central high frequency drivers straddled by mid-range frequency drivers behind waveguide walls. By having the mid-frequency drivers and waveguide walls symmetrical about the center of high frequency drivers, a symmetrical sound wave front is dispersed from the assembly which is preferable in most cases. However, there may be circumstances where an asymmetrical sound dispersion front is desired. In this case, there may only be a mid-range frequency driver or drivers located to one side of the high frequency driver and behind one waveguide wall.

Although the driver assembly has been described and illustrated as comprising two central high frequency drivers and four mid-range frequency drivers, any number and combinations of mid-range frequency drivers and high frequency drivers could be used in accordance with the invention. Furthermore, the drivers may not be split into solely high frequency and mid-range frequency drivers. For example, instead of a mid-range driver to cover the mid-range spectrum of frequencies, there may be one or more smaller mid-range drivers to reproduce the higher end of the mid-range frequency spectrum, and one or more larger mid-range drivers to reproduce the lower end of the mid-range frequency spectrum.

The Waveguide Walls

Figure 3:
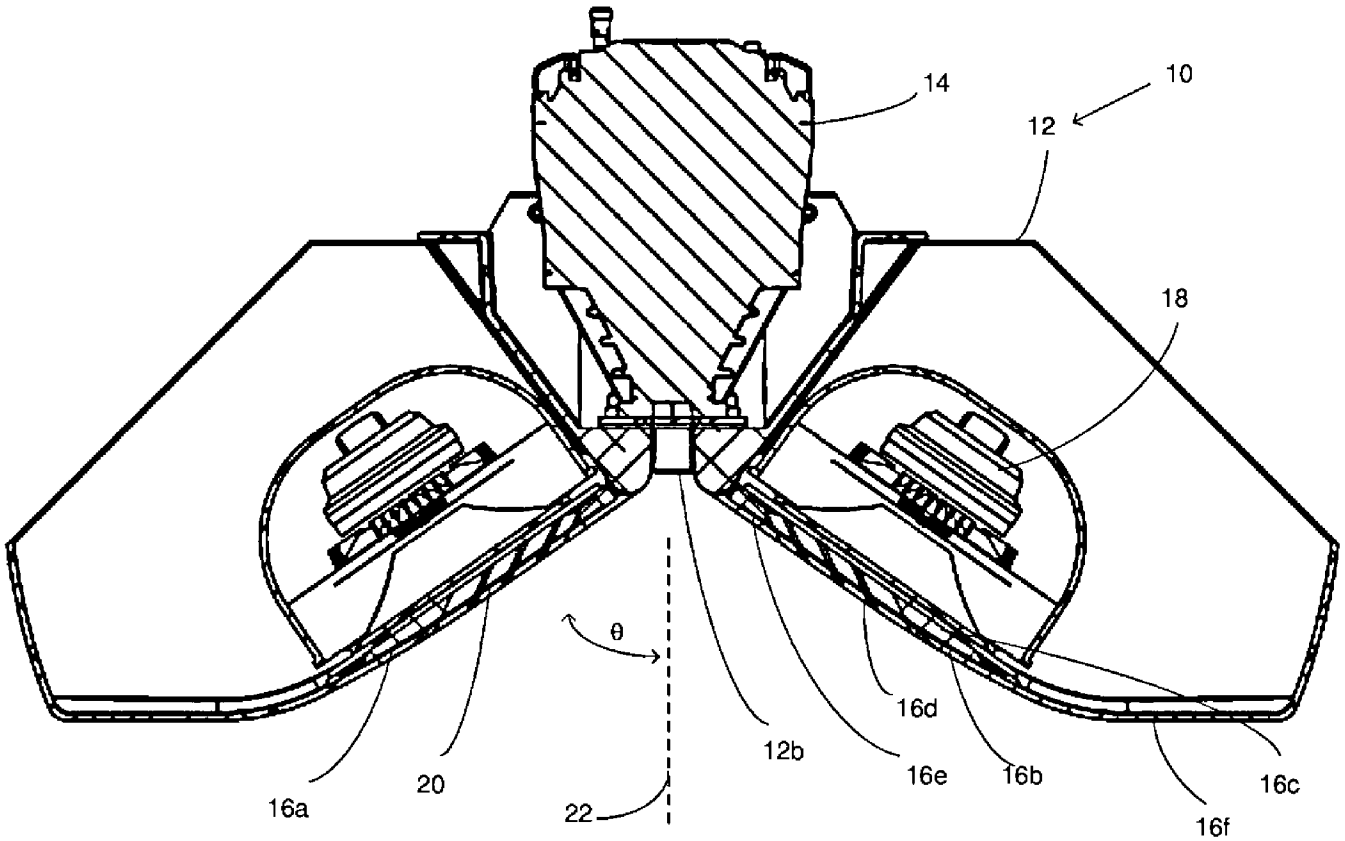
FIG. 3 is a top cross sectional view taken along line 3-3 in FIG. 2 of the speaker driver assembly.
Figure 4:
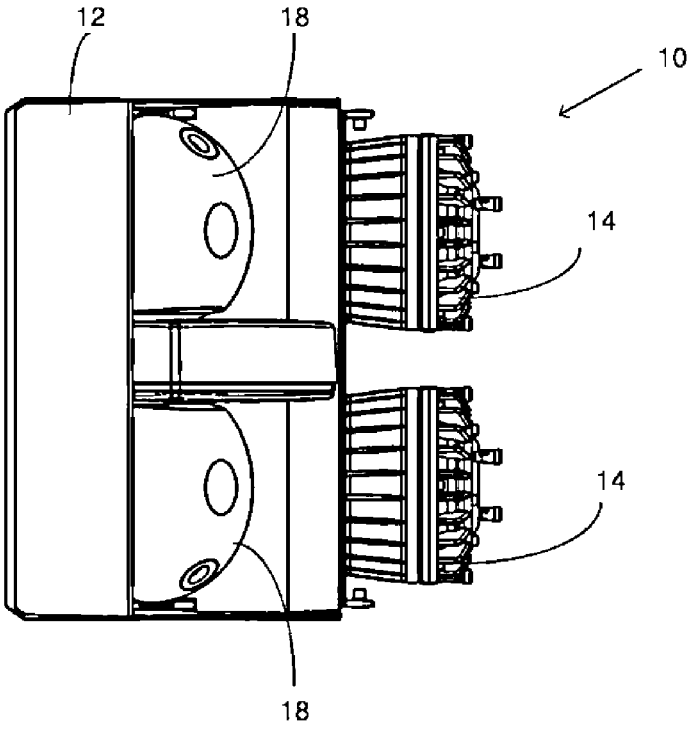
FIG. 4 is a side elevational view of the speaker driver assembly of FIG. 1.
Figure 5:
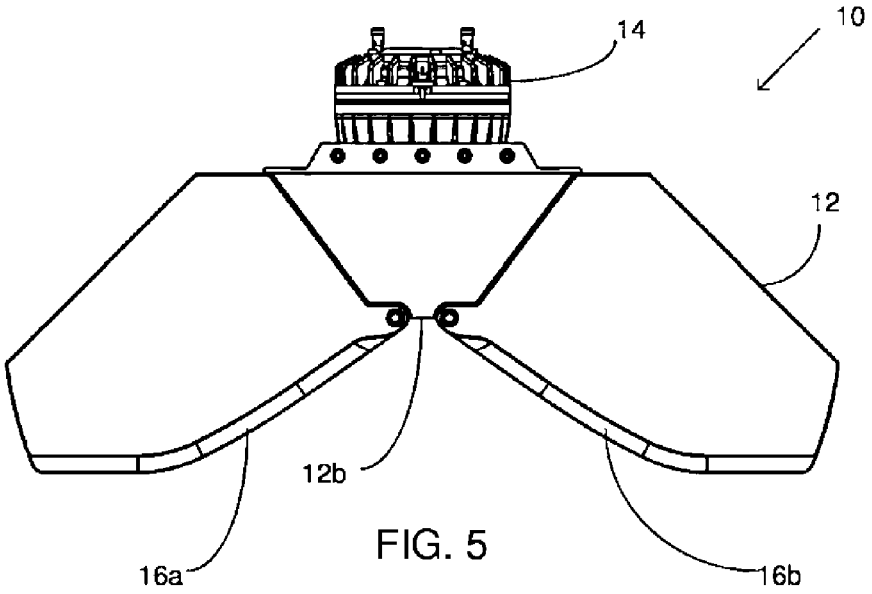
FIG. 5 is a top plan view of the speaker driver assembly of FIG. 1.

Referring to FIG. 3, each waveguide wall 16*a*, 16*b* is shown at an angle θ of approximately 60° from either side of a longitudinal axis 22 of the enclosure, creating a horizontal field of sound dispersion of approximately 120°. The waveguide walls may be positioned at other angles to create the desired horizontal field of sound dispersion for a particular application. The waveguide walls may be adjustable, and it is not necessary for the waveguide walls to be at equal angles from the longitudinal axis.

As shown in FIG. 3, the waveguide walls 16*a,b* are not entirely planar but are curved outwardly at the distal portions 16*f*. Although a specific shape and curvature of waveguide is illustrated, various shapes and curvatures could be used that would be within the scope of the invention.

The waveguide is preferably constructed of any sufficiently rigid material, such as aluminum, plastic, composite, wood or metal.

Experimental Data

Experiments were conducted to determine polar frequency response data for a variety of waveguides on a speaker driver assembly. The frequency response was measured at 5 degree intervals from −180 to +180 degrees across the horizontal place measured at a 1 meter distance from the waveguide by a fast Fourier transform (FFT) analyzer windowed to approximate a semi-anechoic environment. The results are as follows.

Experiment #1—Smooth Waveguide

Figure 12A:
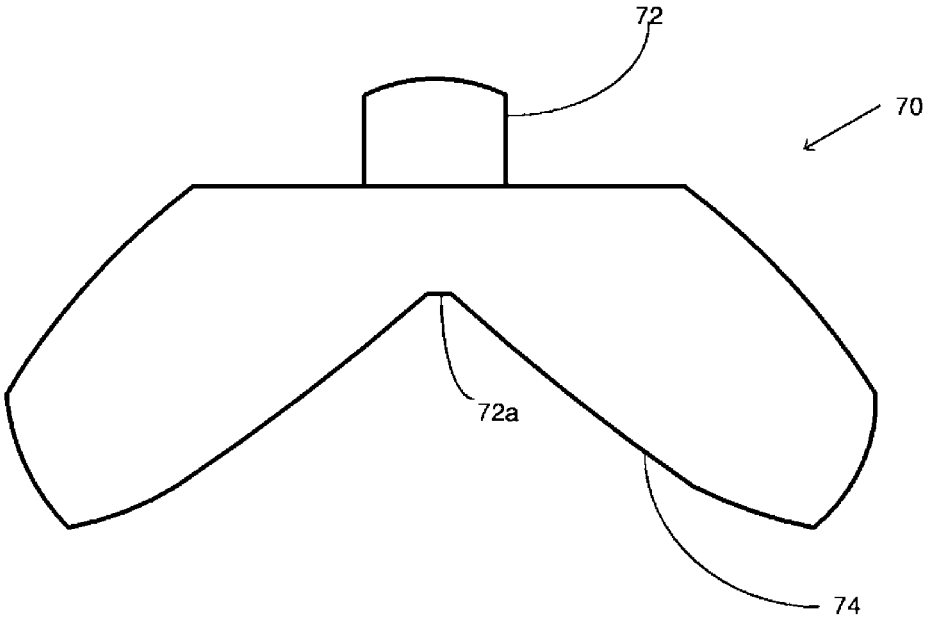
FIG. 12A is a top plan view of a speaker driver assembly having smooth waveguide walls with no mid-range frequency drivers that was tested to illustrate an ideal frequency response.
Figure 12B:
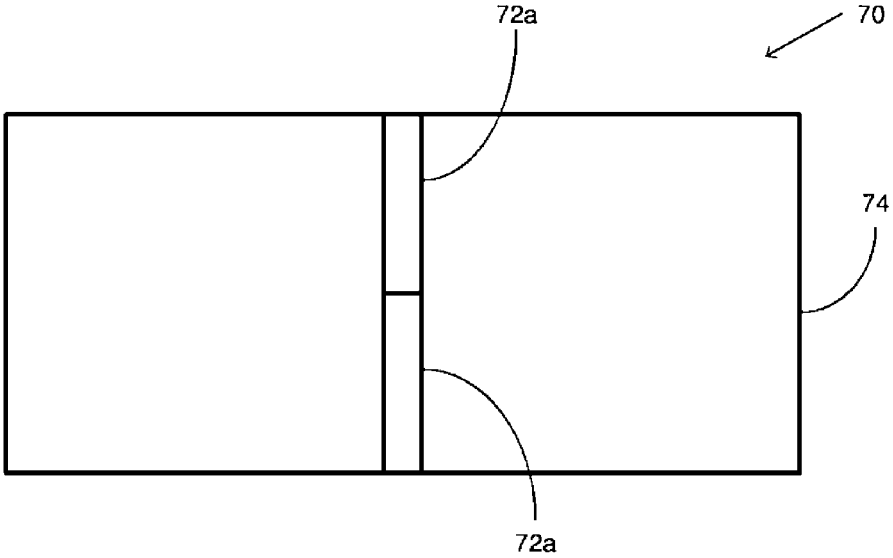
FIG. 12B is a front elevational view of the speaker driver assembly of FIG. 12A.
Figure 12C:
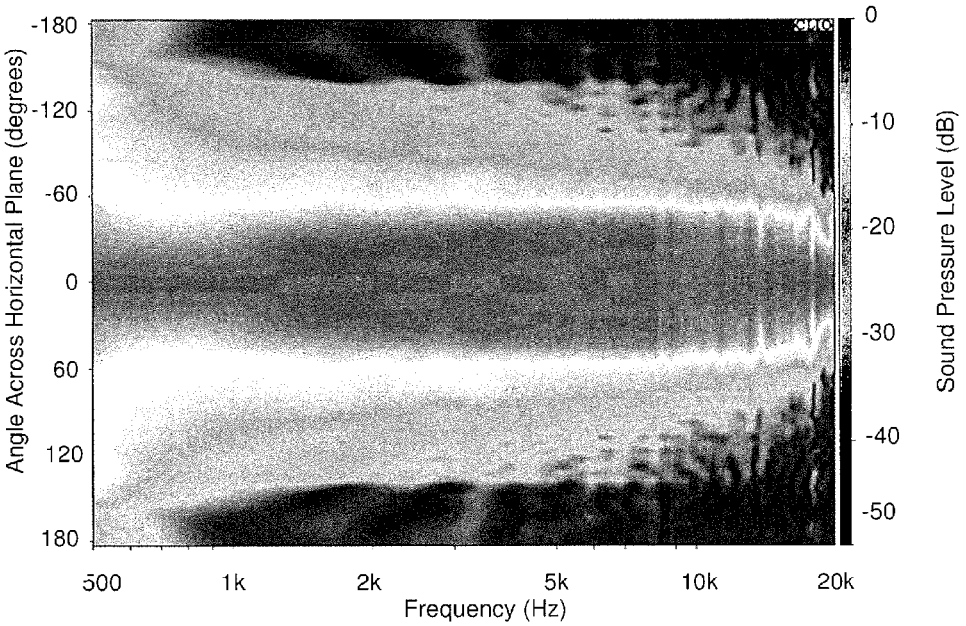
FIG. 12C is a plot illustrating the polar frequency response of the speaker driver assembly of FIGS. 12A and 12B, illustrating an ideal frequency response.

In the first experiment, a speaker assembly having a smooth unobstructed waveguide was tested. FIG. 12A illustrates a top view of the speaker assembly 70, showing the curvature of the waveguide 74 and the high frequency drivers 72. FIG. 12B is a front view of the speaker assembly, illustrating the high frequency openings 72*a* and the smooth unobstructed waveguide 74. FIG. 12C is a polar plot of the frequency response of this assembly. If the behavior of a waveguide and high frequency drivers was perfect, the dark/light interface at +/−60 degrees on the polar plot would be perfectly straight with no inconsistencies on either side of the interface. As can be seen, the polar frequency response of this assembly is quite good and the sound field emitted by this wave guide would be consistent. However, having only high frequency drivers would not allow this assembly to play sufficiently low frequencies (i.e. mid-range frequencies) to cover the required range of frequencies in a professional loudspeaker system.

Experiment #2—Slot Openings

Figure 14A:
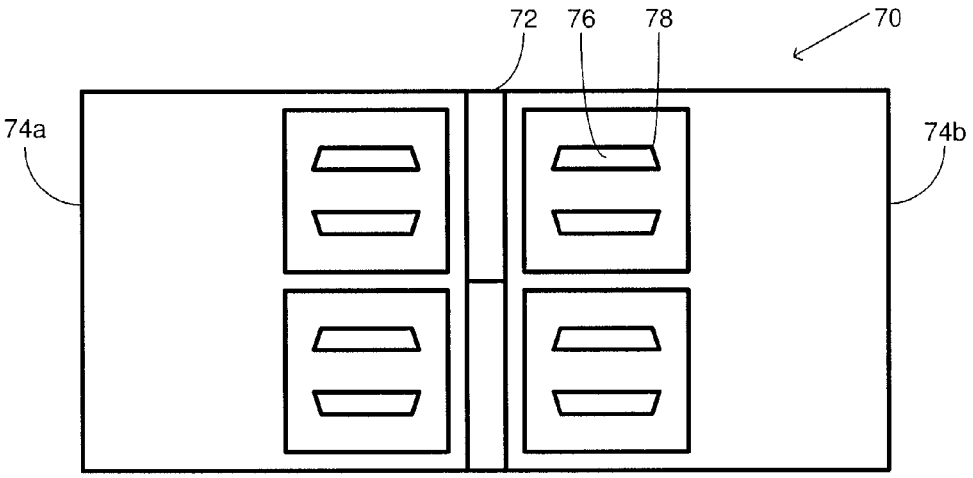
FIG. 14A (PRIOR ART)
FIG. 14A is a front elevational view of a speaker driver assembly of the prior art having horizontal slit-type apertures on the waveguide in front of the mid-range frequency drivers.
Figure 14B:
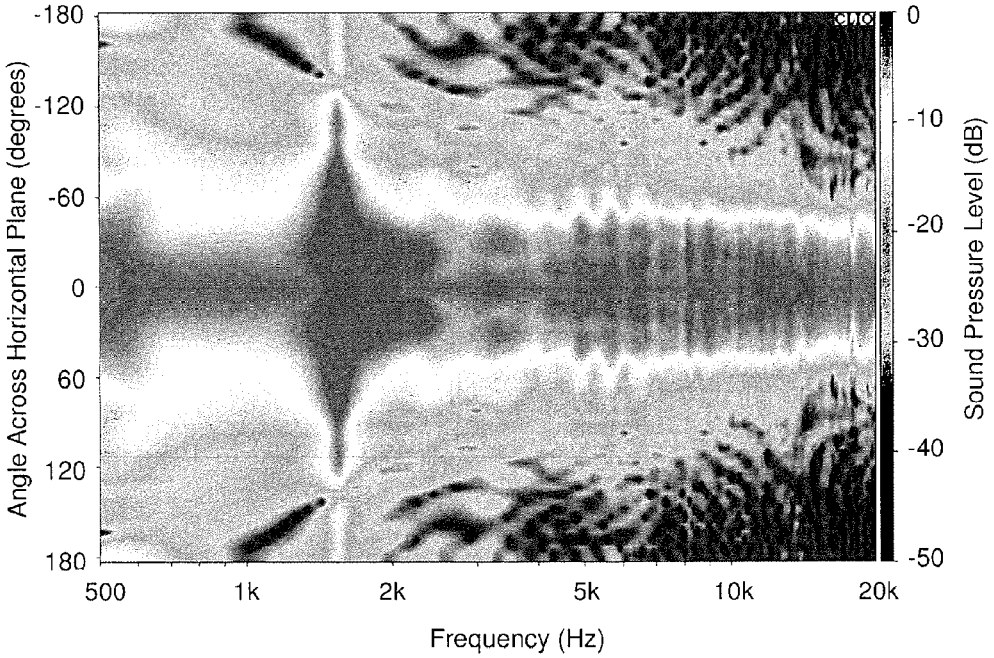
FIG. 14B is a plot illustrating the polar frequency response of the speaker driver assembly of FIG. 14A in accordance with the prior art.

Referring to FIG. 14A, in the second experiment a speaker assembly 70 having partial slot-type horizontal openings 76 on the front of the waveguide walls 74*a*, 74*b* in front of mid-range frequency drivers 78 in accordance with the prior art was tested. FIG. 14B is a polar plot of the frequency response, showing irregularities with side lobing or summations at 1.6 kHz and cancellations from 2 to 6 kHz. The summations and cancellations are a result of the diffraction edges of the openings 76 and the cavity in front of the midrange driver.

Experiment #3—Semi-Circular Openings

Figure 15A:
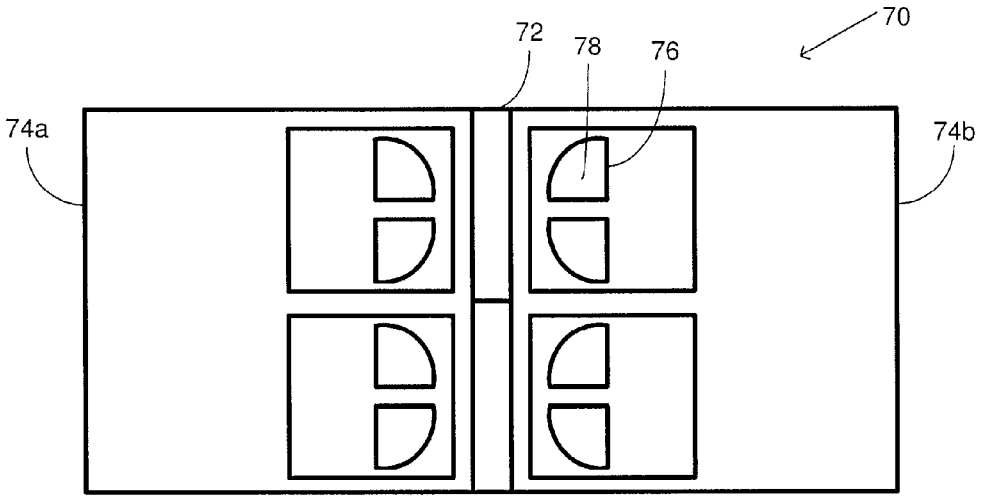
FIG. 15A (PRIOR ART)
FIG. 15A is a front elevational view of a speaker driver assembly of the prior art having quarter circular apertures on the waveguide in front of the mid-range frequency drivers.
Figure 15B:
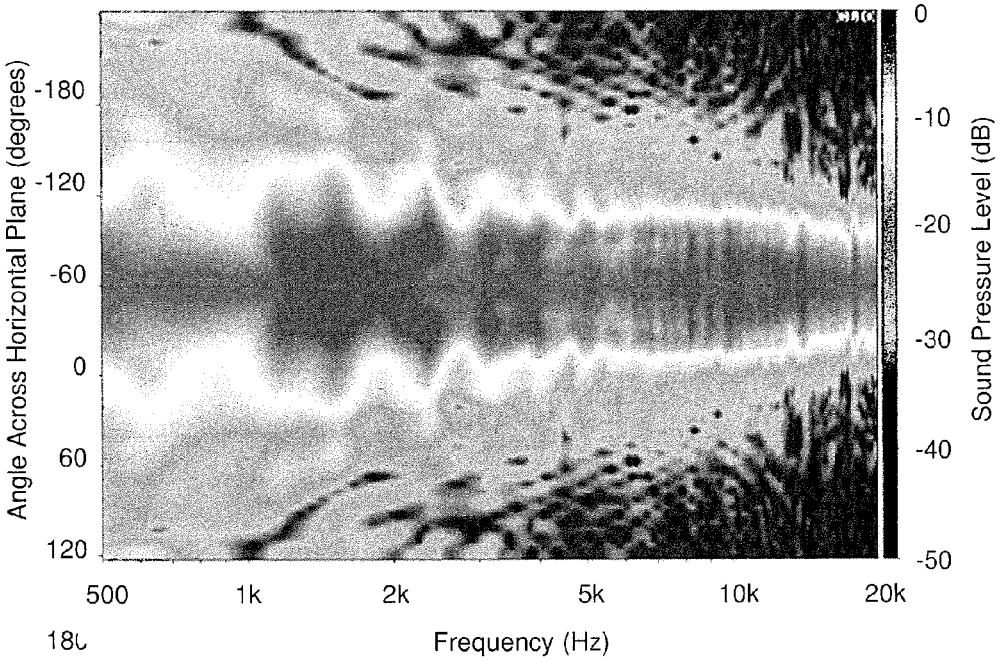
FIG. 15B is a plot illustrating the polar frequency response of the speaker driver assembly of FIG. 15A in accordance with the prior art.
Figure 16B:
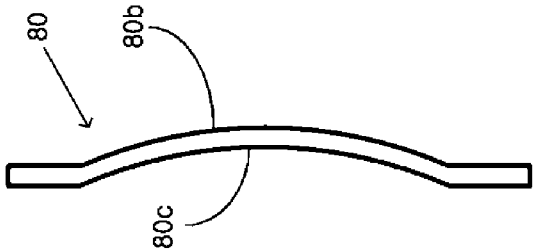
FIG. 16B is a side elevational view of one of the curved waveguide grills of FIG. 16A.
Figure 16A:
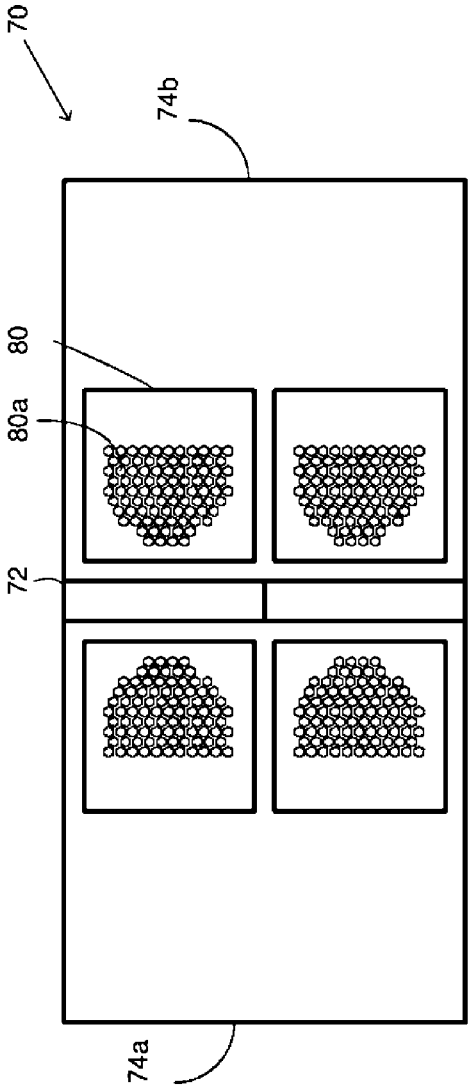
FIG. 16A is a front elevational view of a speaker driver assembly having a waveguide grill with a plurality of small apertures in a semi-circular pattern.
Figure 16C:
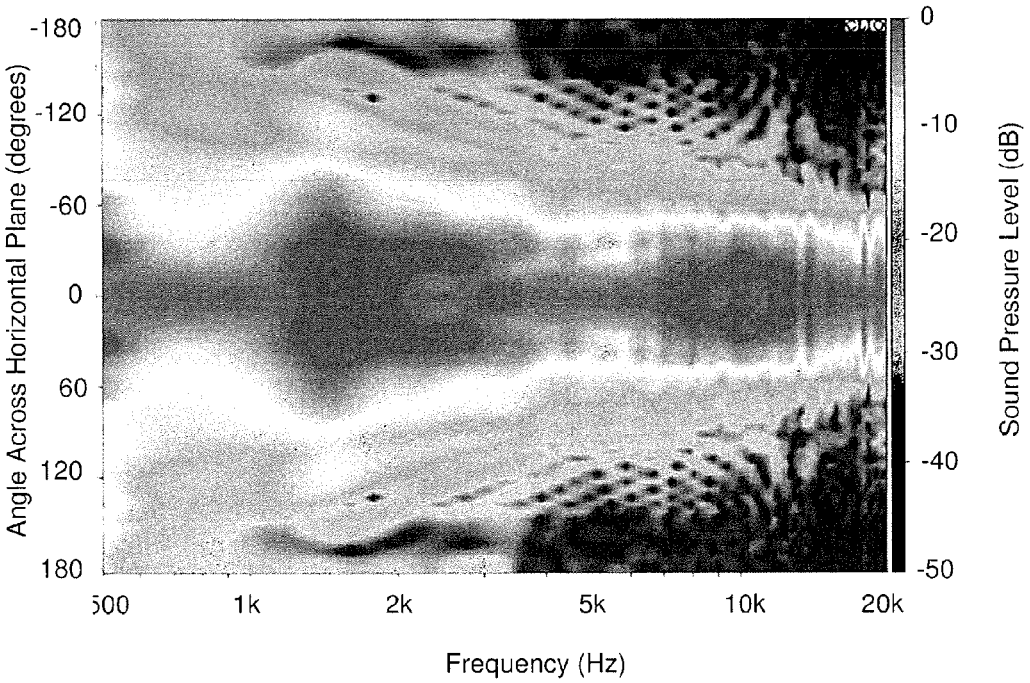
FIG. 16C is a plot illustrating the polar frequency response of the speaker driver assembly of FIGS. 16A and 16B.

In the third experiment, referring to FIG. 15A, a speaker assembly 70 with semi-circular openings 76 in the waveguide walls 74*a, b* in front of the mid-range drivers 78 in accordance with the prior art was tested. Again, as shown in FIG. 15B, there are numerous inconsistencies in the polar frequency response, Experiment #4—Waveguide Grill In the fourth experiment, a standard grill 80 was placed over each mid-range drivers and tested. Referring to FIG. 16A, each grill has a plurality of evenly-sized and evenly-spaced hexagonal apertures 80*a* in a semi-circular configuration. FIG. 16B is a side view of the grill, which has an inner convex surface 80*b* and an outer concave surface 80*c* in order to reduce the volume of the cavity between the inner surface of the grill and the mid-range driver. As can be seen in the polar plot shown in FIG. 16C, the polar frequency is improved over the $2^{nd}$ and $3^{rd}$ experiments in that the interface at +/−60 degrees is smoother, however there are still significant inconsistencies, such as the cancellations occurring off axis from 2.5 kHz to 7 kHz.

Experiment #5—Waveguide Grill with Reduced Number of Apertures

Figure 17A:
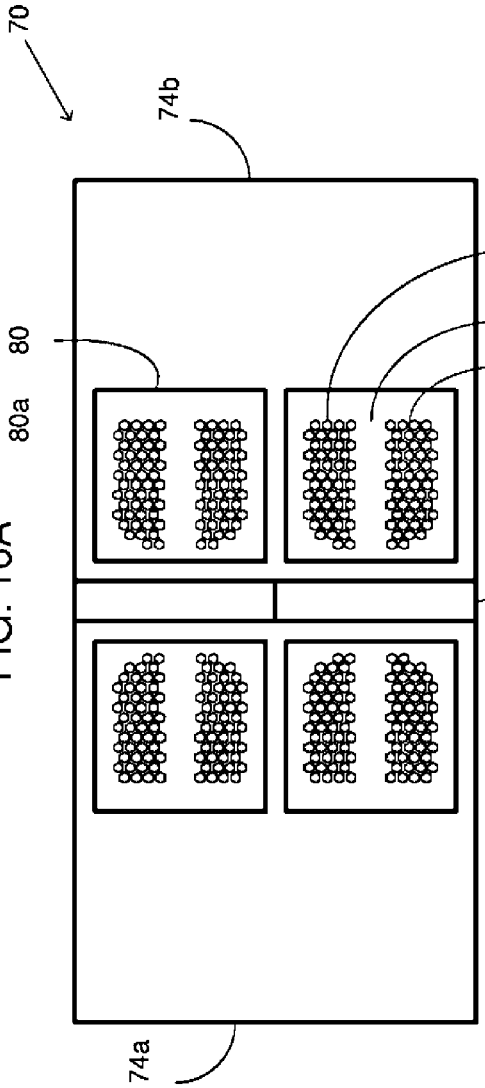
FIG. 17A is a front elevational view of the speaker driver assembly of FIGS. 16A and 16B wherein a middle horizontal portion of the apertures in the grill have been removed.
Figure 17B:
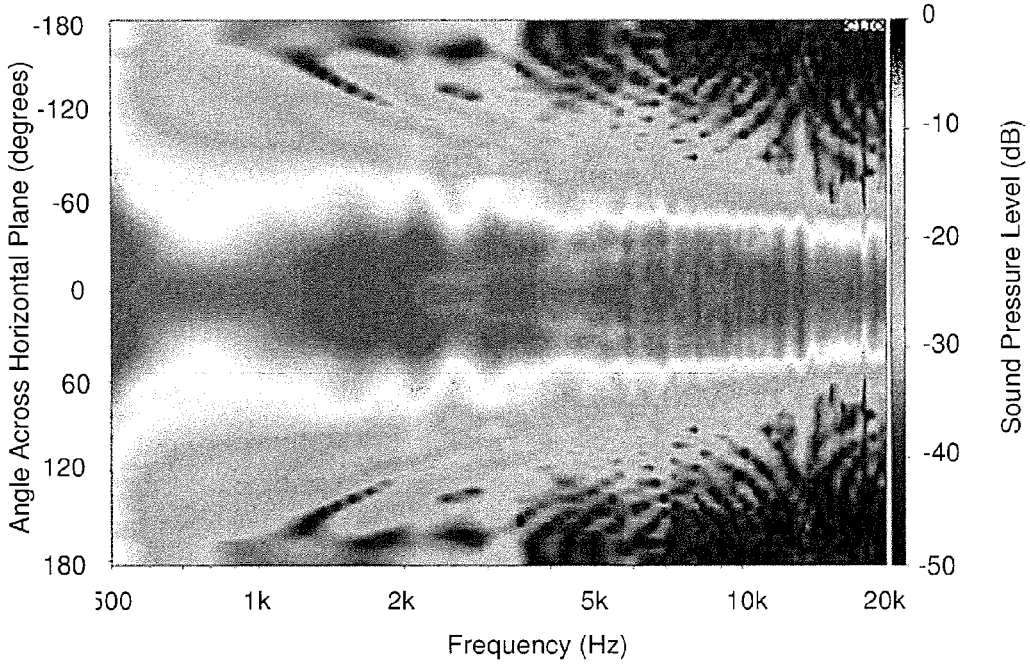
FIG. 17B is a plot illustrating the polar frequency response of the speaker driver assembly of FIG. 17A.

In the fifth experiment, the waveguide grill from the fourth experiment (FIGS. 16A and 16B) was modified to reduce the number of apertures in the grill, and thereby reduce the number of diffractive edges in the path of the high frequency sound waves. FIG. 17A illustrates the modified grill 80, wherein a horizontal middle section 80*d* of apertures were removed, leaving a lower section 80*e* and upper section 80*f* of apertures. As can be seen in the polar plot shown in FIG. 17B, improvements were made above 3.5 kHz, however there were still inconsistencies in the lower frequencies below 3.5 kHz.

Experiment #6—Waveguide Having Small Angled Apertures

Figure 13:
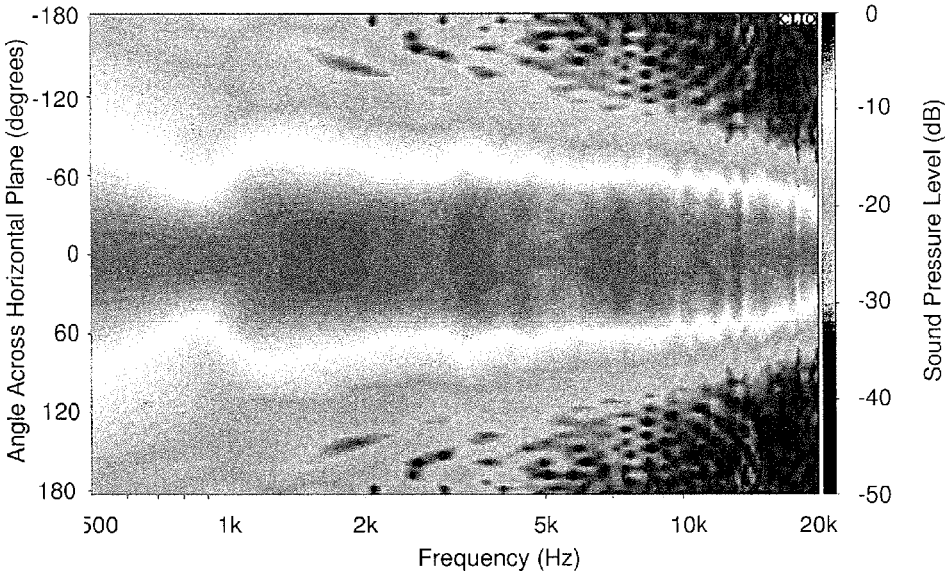
FIG. 13 is a plot illustrating the polar frequency response of the speaker driver assembly of FIGS. 1 to 5 in accordance with one embodiment of the invention.

In the sixth experiment, the waveguide illustrated in FIGS. 1 to 5 in accordance with one embodiment of the invention was tested. As previously described, the waveguide has a plurality of small apertures of varying sizes in a semi-randomized configuration that are angled outwardly from the inner surface to the outer surface of the waveguide. FIG. 13 illustrates the polar frequency response plot for this waveguide. As can be seen, the frequency response is vastly improved as compared with the waveguide of experiments 2 to 5. The polar response is fairly consistent with only a slight narrowing at 800 Hz and 10 kHz.

Applications of the Waveguide

The waveguide of the invention can be used in any loudspeaker system wherein a coherent wave front needs to be created with a combination of mid-range and high frequency drivers. Examples include but are not limited to a professional audio system, a home audio system and commercial public address system.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A waveguide for use in a speaker driver assembly having at least one high frequency driver for emitting sound waves out at least one high frequency opening, and at least one mid-range frequency driver located adjacent the high frequency driver, the waveguide for placement in front of the mid-range frequency driver, the waveguide comprising:

at least one wall having an outer surface, an inner surface and a proximal edge, the inner surface for facing the mid-range frequency driver, and the proximal edge for placement adjacent the high frequency opening; and a plurality of apertures in the at least one wall for allowing sound waves from the mid-range frequency driver to pass through, the apertures angled outwardly away from the proximal edge from the inner surface to the outer surface of the wall for allowing the high frequency sound waves to pass by the outer surface with minimal diffraction from the exit path.

2. The waveguide of claim 1 wherein the plurality of apertures are angled outwardly at an angle of 25 to 75 degrees with respect to the at least one waveguide wall.

3. The waveguide of claim 1 wherein the waveguide comprises at least two walls that form an angle to each other for placement in the speaker driver assembly with the at least one high frequency driver at a vertex of the angle.

4. The waveguide of claim 1 wherein the plurality of apertures are less than 17 mm in diameter.

5. The waveguide of claim 1 wherein the plurality of apertures comprise apertures of more than one size.

6. The waveguide of claim 1 wherein the plurality of apertures comprise apertures of at least three different sizes.

7. The waveguide of claim 1 wherein the spacing between adjacent apertures in the plurality of apertures is not regular.

8. The waveguide of claim 1 wherein the plurality of apertures are arranged in an irregular or semi-randomized configuration.

9. The waveguide of claim 1 wherein the plurality of apertures are arranged in a regular pattern.

10. The waveguide of claim 1 wherein the plurality of apertures are configured symmetrically.

11. The waveguide of claim 1 wherein the plurality of apertures form a geometric pattern.

12. The waveguide of claim 1 wherein each aperture of the plurality of apertures has a substantially constant diameter from the inner surface to the outer surface.

13. The waveguide of claim 1 wherein each aperture of the plurality of apertures is tapered between the inner surface and the outer surface.

14. A waveguide for use in a speaker driver assembly having at least one high frequency driver for emitting sound waves out at least one high frequency opening, and at least one mid-range frequency driver located adjacent the high frequency driver, the waveguide for placement in front of the mid-range frequency driver, the waveguide comprising:

two walls that form an angle to each other for placement in the speaker driver assembly with the at least one high frequency driver at a vertex of the angle, each wall having an outer surface, an inner surface and a proximal edge, the inner surface for facing the mid-range frequency driver, and the proximal edge for placement adjacent the high frequency opening; and a plurality of apertures in each of the walls for allowing sound waves from the mid-range frequency driver to pass through, the apertures angled outwardly away from the proximal edge from the inner surface to the outer surface of each of the walls for allowing the high frequency sound waves to pass by the outer surface with minimal diffraction from the exit path in which the apertures are located at an angle of 25 to 75 degrees with respect to each of the walls.

15. The waveguide of claim 14 wherein the plurality of apertures comprise apertures of more than one size.

16. A speaker driver assembly comprising:

an enclosure having a front side;

at least one high frequency driver in the enclosure for emitting high frequency sound waves on an exit path out a high frequency opening on the front side of the enclosure;

at least one mid-range frequency driver in the enclosure adjacent the high frequency opening for emitting mid-range frequency sound waves; and at least one waveguide wall including an outer surface; an inner surface facing the at least one mid-range frequency driver; a proximal edge adjacent the high frequency opening; and a plurality of apertures for allowing the mid-range frequency sound waves to pass through, the plurality of apertures angled outwardly away from the proximal edge from the inner surface to the outer surface for allowing the high frequency sound waves to pass by the outer surface with minimal diffraction from the exit path.

17. The speaker driver assembly of claim 16 wherein the plurality of apertures are angled outwardly at an angle of 25 to 75 degrees with respect to the at least one waveguide wall.

18. The speaker driver assembly of claim 16 wherein there are two waveguide walls positioned at an angle on either side of the high frequency opening.

19. The speaker driver assembly of claim 16 wherein the plurality of apertures are less than 17 mm in diameter.

20. The speaker driver assembly of claim 16 wherein the plurality of apertures comprise apertures of more than one size.

21. The speaker driver assembly of claim 16 wherein the plurality of apertures comprise apertures of at least three different sizes.

22. The speaker driver assembly of claim 16 wherein the spacing between adjacent apertures in the plurality of apertures is not regular.

23. The speaker driver assembly of claim 16 wherein the plurality of apertures are arranged in an irregular or semi-randomized configuration.

24. The speaker driver assembly of claim 16 wherein the plurality of apertures are arranged in a regular pattern.

25. The speaker driver assembly of claim 16 wherein the plurality of apertures are configured symmetrically.

26. The speaker driver assembly of claim 16 wherein the plurality of apertures form a geometric pattern.

27. The speaker driver assembly of claim 16 wherein each aperture of the plurality of apertures has a substantially constant diameter from the inner surface to the outer surface.

28. The speaker driver assembly of claim 16 wherein each aperture of the plurality of apertures is tapered between the inner surface and the outer surface.

29. The speaker driver assembly of claim 16 wherein minimal diffraction means that a distance travelled of the high frequency sound waves off the exit path and back onto the exit path is less than ¼ of a wavelength of the highest frequency sound waves emitted.

30. The speaker driver assembly of claim 16 wherein there is a plurality of mid-range frequency drivers and there is a cluster of a plurality of apertures in front of each mid-range frequency driver.

31. A speaker driver assembly comprising:

an enclosure having a front side;

at least one high frequency driver in the enclosure for emitting high frequency sound waves on an exit path out a high frequency opening on the front side of the enclosure;

at least one mid-range frequency driver in the enclosure adjacent the high frequency opening for emitting mid-range frequency sound waves; and two waveguide walls each positioned at an angle on either side of the high frequency opening, each waveguide wall including an outer surface; an inner surface facing the at least one mid-range frequency driver; a proximal edge adjacent the high frequency opening; and a plurality of apertures for allowing the mid-range frequency sound waves to pass through, the plurality of apertures angled outwardly away from the proximal edge from the inner surface to the outer surface at an angle of 25 to 75 degrees for allowing the high frequency sound waves to pass by the outer surface with minimal diffraction from the exit path.

32. The speaker driver assembly of claim 31 wherein the plurality of apertures comprise apertures of more than one size.

33. A speaker cabinet for use in a speaker system comprising the speaker driver assembly of claim 16.

* * * * *